US007996940B1

(12) United States Patent
Dahm et al.

(10) Patent No.: US 7,996,940 B1
(45) Date of Patent: Aug. 16, 2011

(54) CUSTOM THERAPEUTIC SEAT CUSHION

(75) Inventors: Matt Dahm, St. Petersburg, FL (US); Daniel Duduka, North Port, FL (US); Mark Olsen, Tampa, FL (US); Jeffrey Herron, Thonotosassa, FL (US)

(73) Assignee: University of South Florida, Tampa, FL (US)

( * ) Notice: Subject to any disclaimer, the term of this patent is extended or adjusted under 35 U.S.C. 154(b) by 112 days.

(21) Appl. No.: 12/549,001

(22) Filed: Aug. 27, 2009

Related U.S. Application Data

(60) Provisional application No. 61/092,280, filed on Aug. 27, 2008.

(51) Int. Cl.
*A47C 27/18* (2006.01)

(52) U.S. Cl. ..... 5/654; 5/655.3; 5/655.9; 297/452.41

(58) Field of Classification Search ..... 5/653, 654, 5/655.3, 655.9, 709, 710, 718–720; 297/452.41
See application file for complete search history.

(56) References Cited

U.S. PATENT DOCUMENTS 4,796,948 A 1/1989 Paul et al.
5,369,828 A * 12/1994 Graebe ..... 5/654
5,836,027 A * 11/1998 Leventhal et al. ..... 5/706
5,845,352 A * 12/1998 Matsler et al. ..... 5/654
5,868,463 A 2/1999 MacKenzie et al.
6,009,578 A * 1/2000 Davis ..... 5/653
6,216,299 B1 4/2001 Kohlman
6,560,803 B2 * 5/2003 Zur ..... 5/654
6,623,080 B2 * 9/2003 Clapper ..... 297/452.41
6,901,617 B2 * 6/2005 Sprouse et al. ..... 5/654
7,434,283 B2 * 10/2008 Wilkinson et al. ..... 5/713
7,441,294 B2 * 10/2008 Mossbeck ..... 5/654
2004/0123391 A1 * 7/2004 Call ..... 5/630

* cited by examiner

*Primary Examiner* — Michael Trettel

(74) *Attorney, Agent, or Firm* — Jeremy Spier; Smith & Hopen, P.A.

(57) ABSTRACT

A seat cushion employing the benefit of a foam cushion and alternating pressure air cushion. An air bladder reservoir with vertically extending fingers is located beneath a foam core with vertical holes. The vertically extending fingers are aligned with the vertical holes of the foam core. The air bladder reservoir and vertically extending fingers are inflated and deflated by a compressor system which provides alternating timed pressure. When inflated, the fingers protrude through the holes in the foam core beyond the top surface of the foam core. A method for fabricating the vertically extending fingers includes a cloth material coated in silicon.

14 Claims, 7 Drawing Sheets

CUSTOM THERAPEUTIC SEAT CUSHION

CROSS REFERENCE TO RELATED PATENT APPLICATION

This application claims priority to currently pending U.S. Provisional Patent Application No. 61/092,280, entitled "Custom Therapeutic Seat Cushion," filed on Aug. 27, 2008, which is herein incorporated by reference.

BACKGROUND OF THE INVENTION

1. Field of Invention

This invention relates generally to cushion devices for individuals who remain sedentary for prolonged periods. More specifically, it relates to a combination foam cushion and air cushion that provides adequate support and timed pressure relief thereby reducing or eliminating pressure sores.

2. Description of the Prior Art

Paraplegics, quadriplegics, pilots, truck drivers, receptionists, and others remain sedentary for prolonged periods of time. During prolonged sitting, blood flow can be restricted to areas where pressure is the greatest. This restricted blood flow results in tissue deterioration and can lead to further complications like pressure sores and infections. Although people living with paralysis are especially at risk, anyone who is bedridden, uses a wheelchair, sits for prolonged periods of time, or is unable to change positions without help can develop these problems.

Conventional seat cushions include foam, air cylinder, gel, and honeycomb structures. These cushions provide many benefits such as comfort and stability, but none of them alone successfully addresses the problem of pressure sores which are caused by long periods of static pressure. A foam cushion provides adequate support, but still can produce too much pressure against the skin, causing pressure sores. An adjustable air cushion allows the user to adjust the pressure, but does not supply adequate support. Hence, there is a need for a reliable and cost effective solution that combines the support of a foam cushion with the ability to regulate the air pressure at varying time intervals. However, in view of the prior art considered as a whole at the time the present invention was made, it was not obvious to those of ordinary skill in this art how the identified needs could be met.

SUMMARY OF INVENTION

In view of the foregoing problems, an objective of the present invention is to alleviate pressure sores for individuals who spend large periods of time seated. In the present design, a foam portion of the cushion allows for stable support of the user, while an air bladder system provides timed pressure relief, thus incorporating the advantages of both the air and foam cushions. The novel combination air cushion and foam cushion system provides the needed sturdiness of a foam cushion and the timed pressure relief of an air cushion, resulting in a comfortable and safe seat cushion that reduces the risk of pressure sores.

An air bladder reservoir with vertically extending fingers is located beneath a foam core with vertical holes. The vertically extending fingers are aligned with the vertical holes of the foam core. The air bladder reservoir and vertically extending fingers are inflated and deflated by a compressor system that provides timed pressure relief. When inflated, the vertically extending fingers protrude through the holes in the foam core beyond the top surface of the foam core. The inner and outer portions of the foam core are different densities.

Additionally, this invention includes a method for fabricating the vertically extending fingers whereby a cloth material is coated in silicon.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
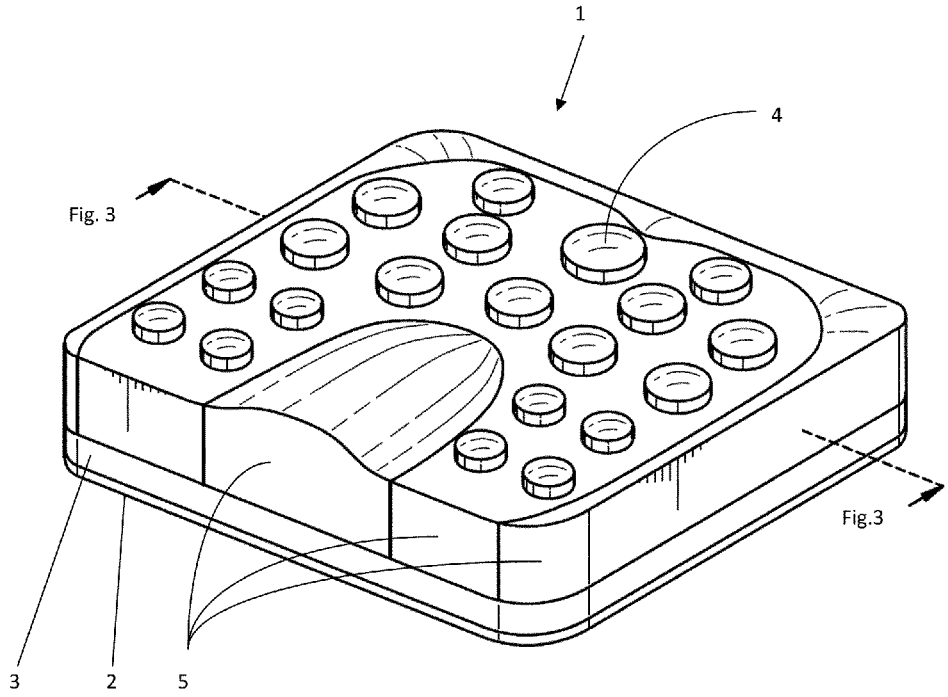
FIG. 1 is an upper perspective view of the seat cushion.

As illustrated in FIG. 1, seat cushion 1 has base 2, air bladder reservoir 3, an array of vertically extending fingers 4, and foam core 5. Air bladder reservoir 3 enables optimal pressure distribution to selected areas and foam core 4 provides stable support for the user.

Figure 4:
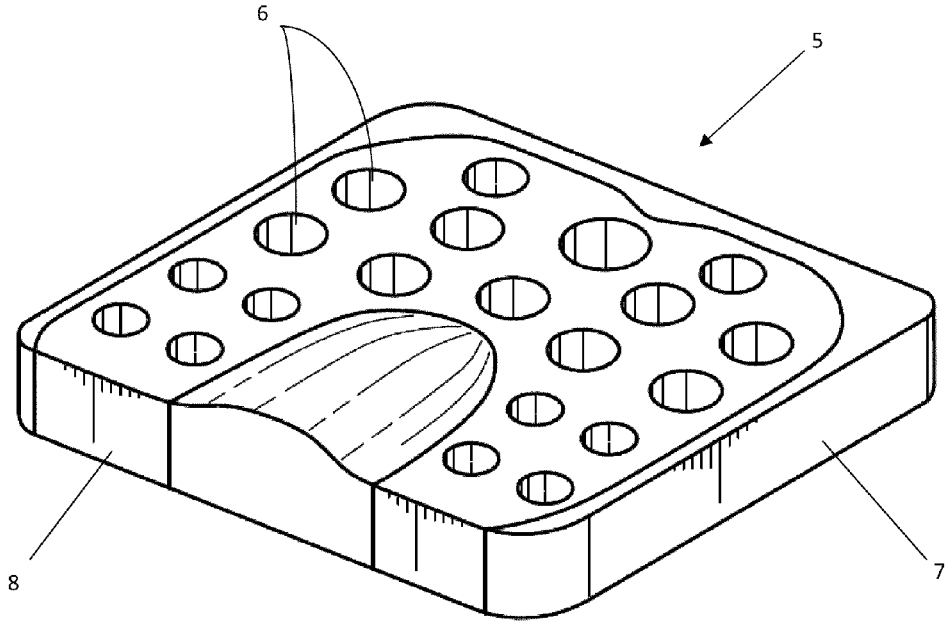
FIG. 4 is an upper perspective of foam cushion.

As depicted in FIG. 4, foam core 5 has an array of vertical holes, collectively denoted 6. The arrangement of the vertical holes is in a U shape to fit the contour of a users' buttock, but any ergonomically beneficial shape may be utilized. Similarly, foam core 5 has a top surface contoured to fit the shape of an individual's buttock in an ergonomically seated position. Additionally, foam core 5 has a greater density and firmness at outer horizontal portion 7, and has a lower density and firmness at inner horizontal portion 8. The greater density and firmness of the outer horizontal portion of the foam core gives the cushion strength to support a user, while the lower density and firmness of the inner horizontal portion of the foam core provides greater resiliency and enhances conformity to the user's posture, thereby providing additional comfort to the user. Inner horizontal portion 8 has a U shape to fit the contour of the users' buttock, but any ergonomically beneficial shape may be utilized. Outer horizontal portion 7 encompasses the curvature of inner portion 8 and provides support to the outer walls of inner portion 8.

Figure 5:
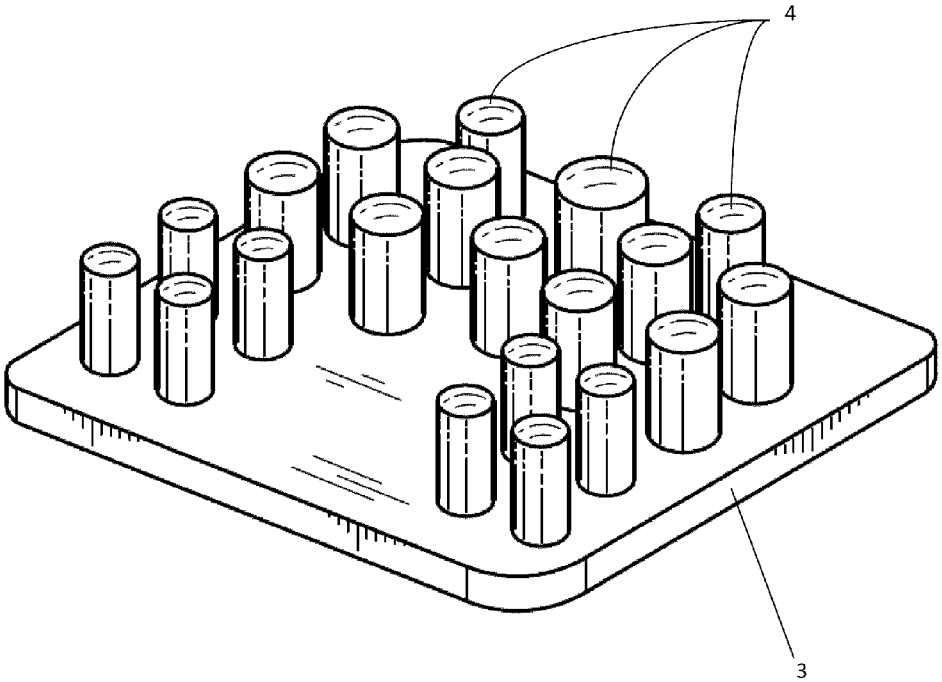
FIG. 5 is an upper perspective of the air bladder reservoir and extending fingers.

As illustrated in FIG. 5, air bladder reservoir 3 has an array of vertically extending fingers, collectively denoted 4.

Figure 6:
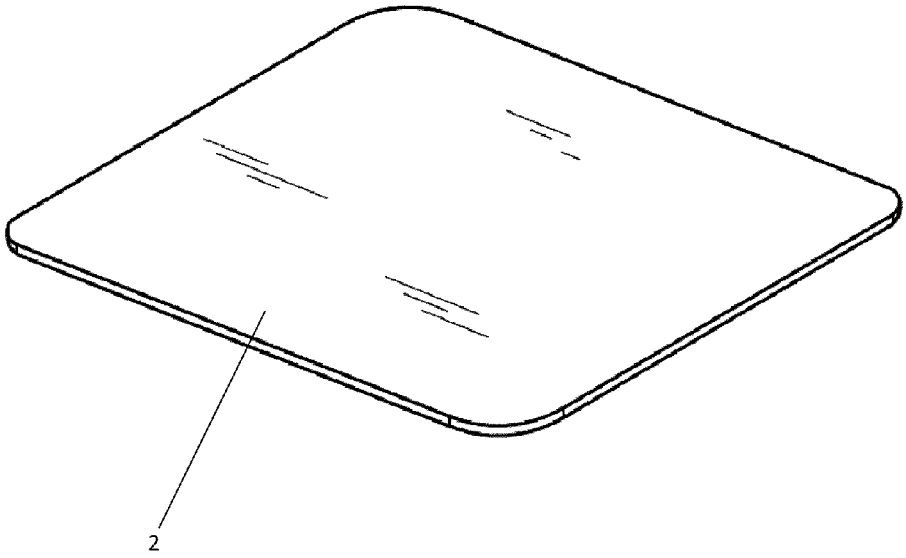
FIG. 6 is an upper perspective of the base.

FIG. 6 depicts base 2 as having a rectangular shape; however, base 2 may be any shape that fits within the seat of a chair. Base 2 is made of wood coated fiberglass, but any rigid or supportive material can be used.

Figure 2:
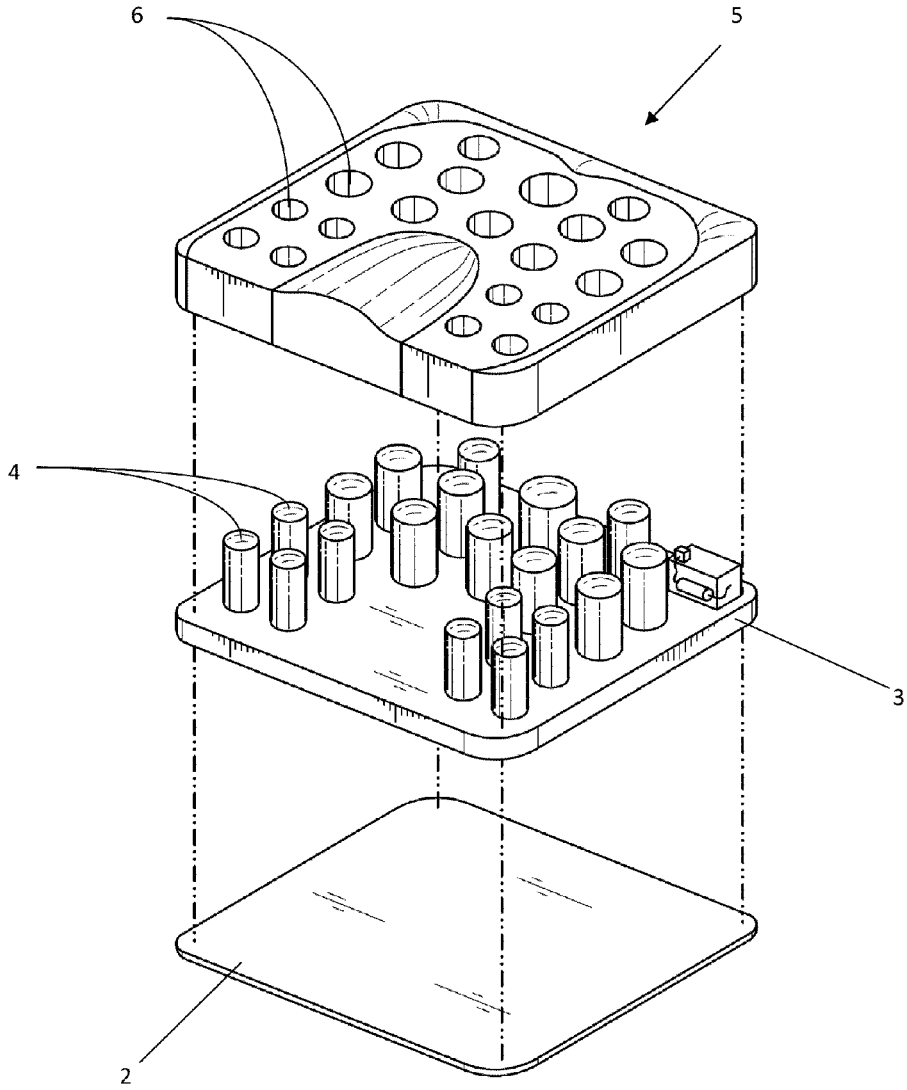
FIG. 2 is an exploded view of the seat cushion.

FIG. 2 depicts vertically extending fingers 4 aligned with and extending through vertical holes 6 of foam core 5. Air bladder reservoir 3 and array of vertically extending fingers 4 are secured to foam core 5 to allow air bladder reservoir 3 and array of vertically extending fingers 4 to inflate and deflate without restraint. Foam core 5, air bladder reservoir 3, and array of vertically extending fingers 4 are secured to base 2.

Figure 3:
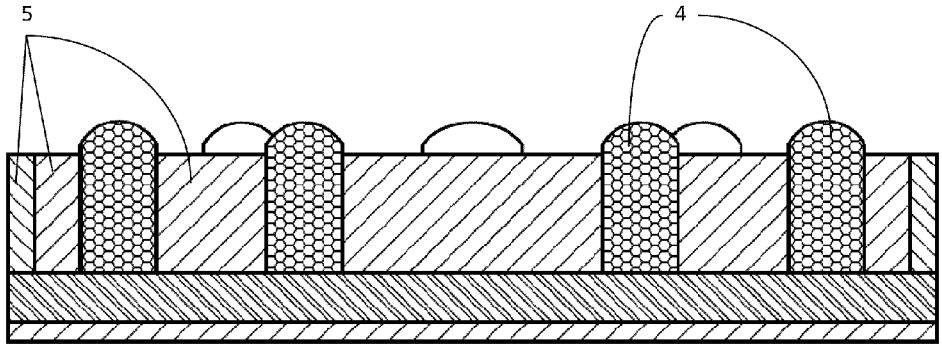
FIG. 3 is a cross sectional view of the seat cushion.

Vertically extending fingers 4 protrude beyond the top surface of foam core 5 when fully inflated, as depicted in FIG. 3. This allows users to receive both the benefit of a foam core and an air cushion.

Figure 7:
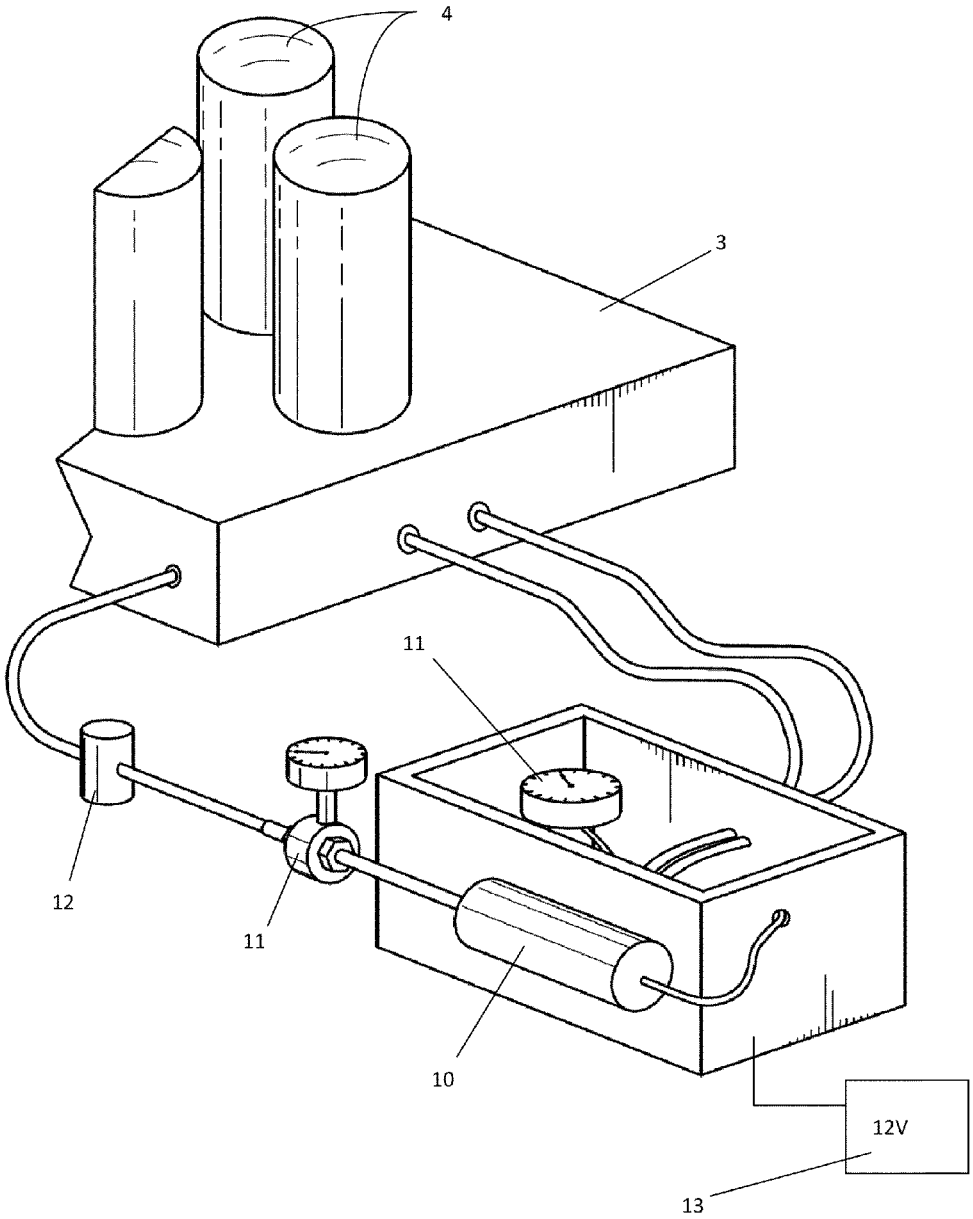
FIG. 7 illustrates the timed pressure relief apparatus.

As illustrated in FIG. 7, air bladder reservoir 3 and array of vertically extending fingers 4 are in fluid communication with 5-10 psi compressor 9, pressure regulator 10, time clock 11, solenoid valve 12, and 12V electrical supply 13. The compressor, pressure regulator, time clock, solenoid valve, and 12V electrical supply inflate and deflate air bladder reservoir 3 and vertically extending fingers 4 at predefined time intervals. The timed pressure relief results in a comfortable and safe seat cushion that reduces the risk of pressure sores.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

What is claimed is:

1. A seat cushion, comprising:

a foam core having a plurality of vertical holes, said foam core having an outer portion and an inner portion;

an air bladder reservoir secured beneath said foam core, said air bladder reservoir having a plurality of vertically extending fingers aligned with and extending through said plurality of vertical holes of said foam core;

a base secured beneath said air bladder reservoir; and a pressure regulating apparatus in fluid communication with said air bladder reservoir and said plurality of vertically extending fingers, whereby said pressure regulating apparatus regulates a pressure within said air bladder reservoir and said plurality of vertically extending fingers at varying time intervals.

2. A seat cushion as in claim 1, further comprising:

said foam core having a top surface contoured to fit a shape of an individual's buttock in an ergonomically seated position.

3. A seat cushion as in claim 1, further comprising:

said outer foam core portion having greater density and firmness to allow for a stable support structure.

4. A seat cushion as in claim 1, further comprising:

said inner foam core portion having decreased density and firmness to provide additional comfort and conformity to an individual's buttock in an ergonomically seated position.

5. A seat cushion as in claim 1, further comprising:

said inner foam core portion having a U shape.

6. A seat cushion as in claim 1, further comprising:

said inner foam core portion including said plurality of vertical holes.

7. A seat cushion as in claim 1, further comprising:

said outer foam core portion including said plurality of vertical holes.

8. A seat cushion as in claim 1, further comprising:

said plurality of vertically extending fingers being inflated and deflated within said plurality of vertical holes of said foam core.

9. A seat cushion as in claim 1, further comprising:

said fully inflated plurality of vertically extending fingers protruding beyond a top surface of said foam core.

10. A seat cushion as in claim 1, further comprising:

said plurality of vertical holes in the said foam core being arranged in a U shape; and said plurality of vertically extending fingers being arranged in a U shape.

11. A seat cushion as in claim 1, further comprising:

a means for inflating, deflating, and regulating the pressure in said air bladder reservoir and said plurality of vertically extending fingers.

12. A seat cushion as in claim 1, further comprising:

a compressor in fluid communication with said air bladder reservoir;

a pressure regulator in fluid communication with said compressor and said air bladder reservoir;

a time clock and solenoid valve in electronic and fluid communication with said compressor and said air bladder reservoir, respectively; and an electrical system.

13. A seat cushion, comprising:

a foam core having a plurality of vertical holes;

an air bladder reservoir secured beneath said foam core, said air bladder reservoir having a plurality of vertically extending fingers aligned with and extending through said plurality of vertical holes of said foam core;

a base secured beneath said air bladder reservoir; and a pressure regulating apparatus in fluid communication with said air bladder reservoir and said plurality of vertically extending fingers, whereby said pressure regulating apparatus regulates a pressure within said air bladder reservoir and said plurality of vertically extending fingers at varying time intervals causing said fully inflated plurality of vertically extending fingers to protrude beyond a top surface of said foam core.

14. A seat cushion, comprising:

a foam core having a plurality of vertical holes, said plurality of vertical holes in said foam core being arranged in a U shape;

an air bladder reservoir secured beneath said foam core, said air bladder reservoir having a plurality of vertically extending fingers aligned with and extending through said plurality of vertical holes of said foam core, said plurality of vertically extending fingers being arranged in a U shape to correspond to said U shape of said plurality of vertical holes in said foam core;

a base secured beneath said air bladder reservoir; and a pressure regulating apparatus in fluid communication with said air bladder reservoir and said plurality of vertically extending fingers, whereby said pressure regulating apparatus regulates a pressure within said air bladder reservoir and said plurality of vertically extending fingers at varying time intervals.

* * * * *